United States Patent [19]

Houck et al.

[11] Patent Number: 4,600,027

[45] Date of Patent: Jul. 15, 1986

[54] CIGARETTE AND METHOD OF MAKING IT

[75] Inventors: Willie G. Houck; Reginald W. Newsome; Walter A. Nichols, all of Richmond; Richard A. Thesing, Glen Allen, all of Va.

[73] Assignee: Philip Morris Incorporated, New York, N.Y.

[21] Appl. No.: 582,599

[22] Filed: Feb. 22, 1984

Related U.S. Application Data

[63] Continuation-in-part of Ser. No. 401,380, Jul. 23, 1982, abandoned.

[51] Int. Cl.[4] ..... A24D 3/04

[52] U.S. Cl. ..... 131/336; 131/338

[58] Field of Search ..... 131/336, 338–341, 131/198 A, 361

[56] References Cited

U.S. PATENT DOCUMENTS

| | | | |
|---|---|---|---|
| 1446472 | 8/1976 | GBX . | |
| 3,608,561 | 9/1971 | Dock | 131/10 A |
| 3,789,855 | 2/1974 | Norman | 131/9 |
| 4,340,074 | 7/1982 | Tudor | 131/362 |
| 4,380,241 | 4/1983 | Horsewell . | |
| 4,433,696 | 2/1984 | Adams | 131/336 |

FOREIGN PATENT DOCUMENT 1446472 8/1976 United Kingdom .

*Primary Examiner*—V. Millin
*Assistant Examiner*—H. Macey
*Attorney, Agent, or Firm*—Jeffrey H. Ingerman

[57] ABSTRACT

A cigarette is provided which comprises a substantially cylindrical tobacco rod, and an integral, axially aligned, substantially cylindrical assembly at the mouth end of the cigarette which preferably includes a wrapped substantially cylindrical filter plug and tipping paper, and which is provided with a mechanism to adjust the air dilution value of the cigarette. The assembly has first and second ends, which are open to permit the passage of air and smoke, and at least two openings in addition to the open ends. Structure is provided for rotating one opening relative to the other so that the openings are in varying degrees of registry to permit varying amounts of air to combine with and dilute the smoke. A method of making the cigarette is also disclosed.

38 Claims, 20 Drawing Figures

FIG. 1
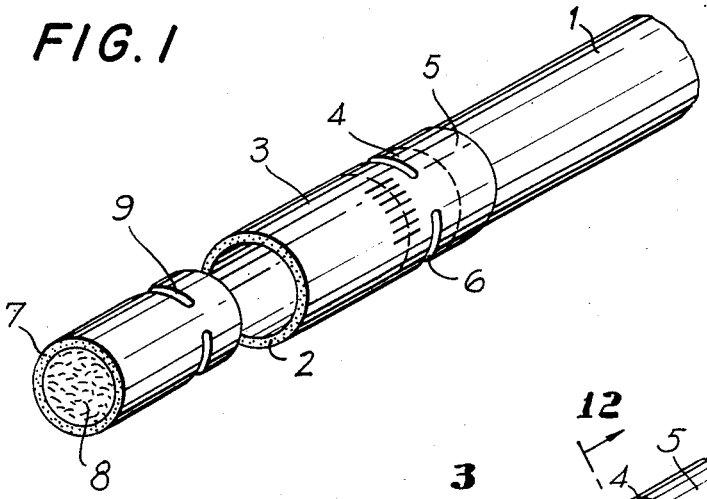
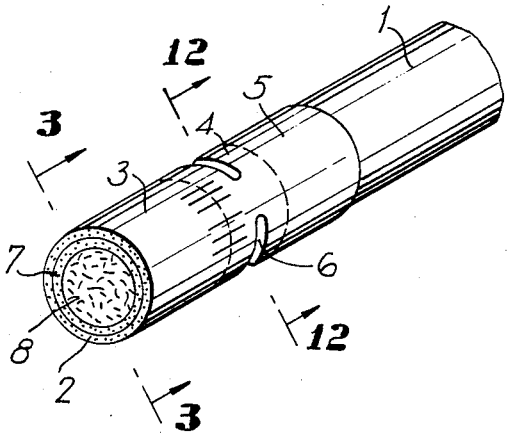
FIG. 2
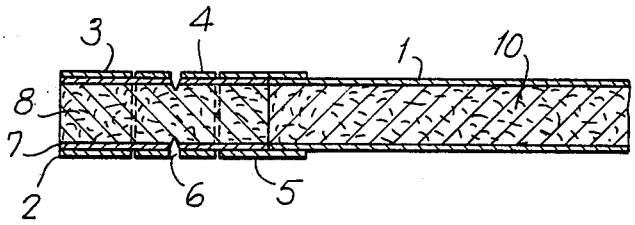
FIG. 3

FIG. 4
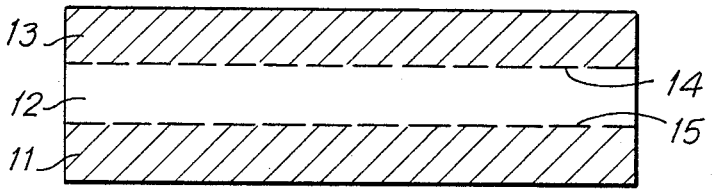
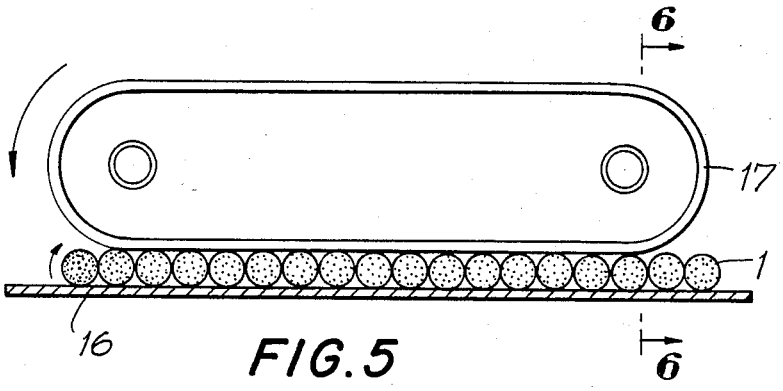
FIG. 5
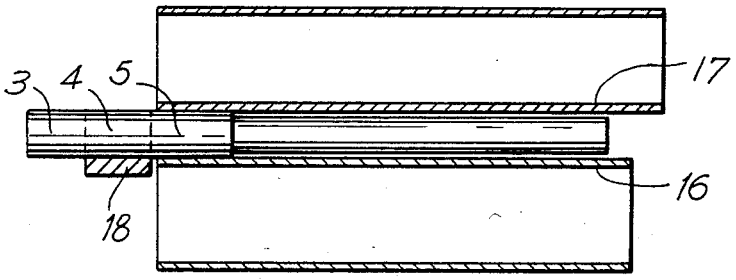
FIG. 6

FIG.7
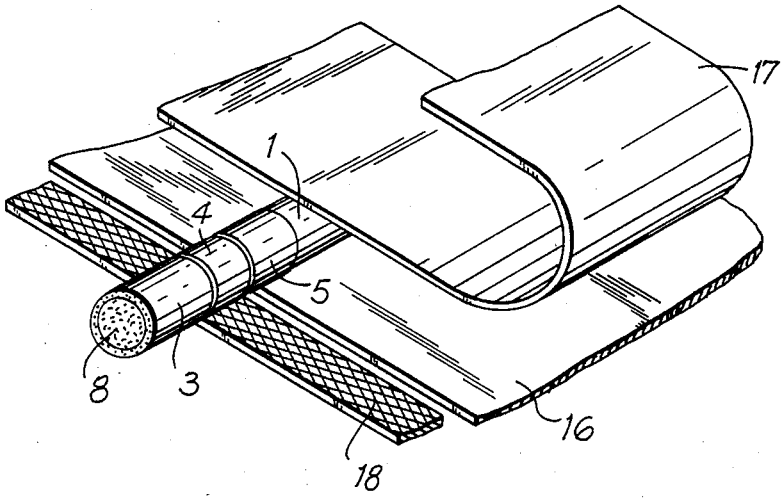
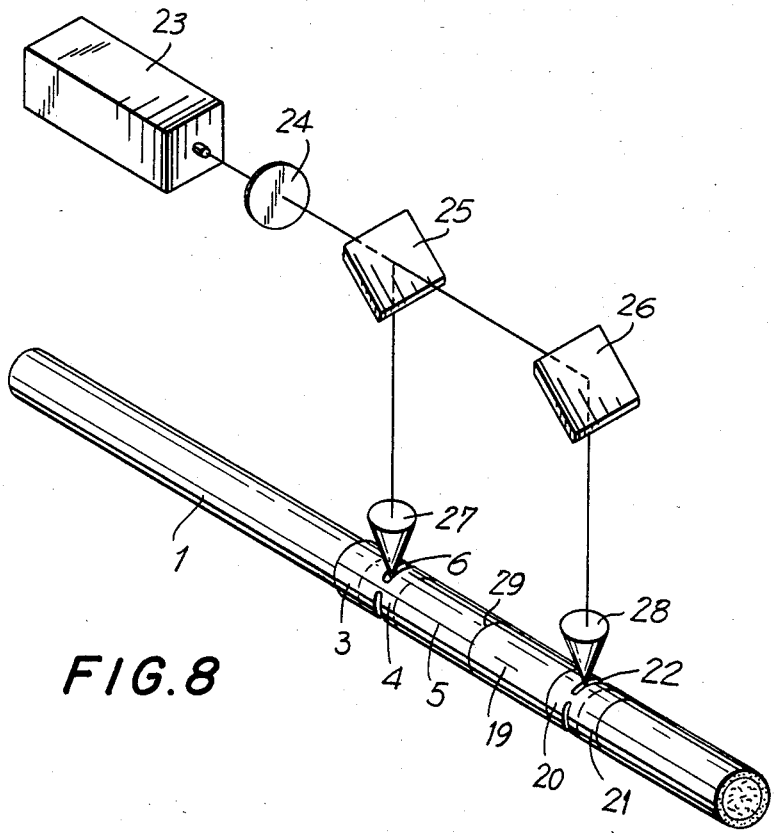
FIG.8

FIG. 9
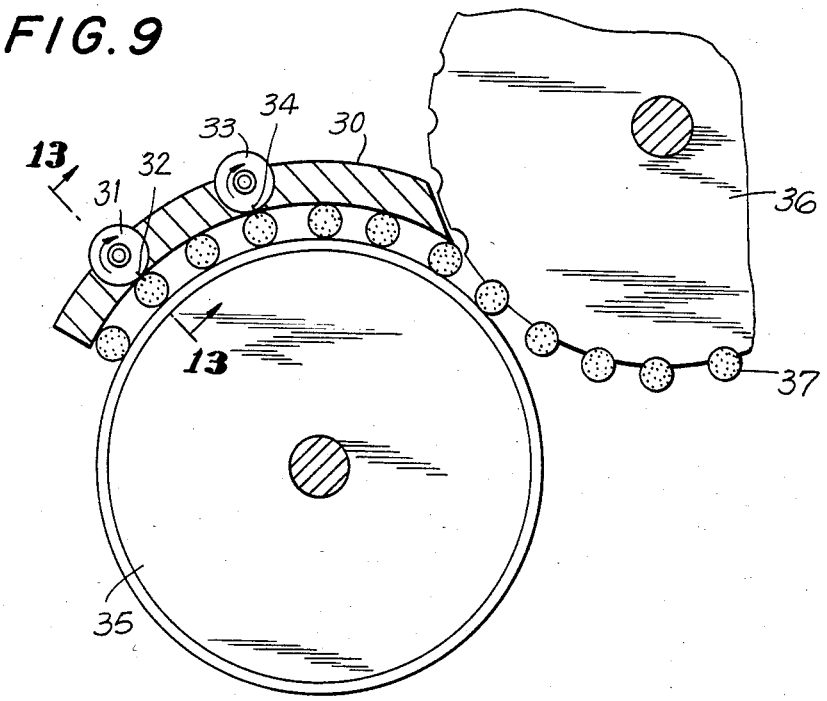
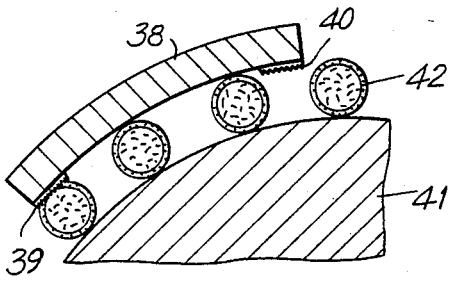
FIG. 10
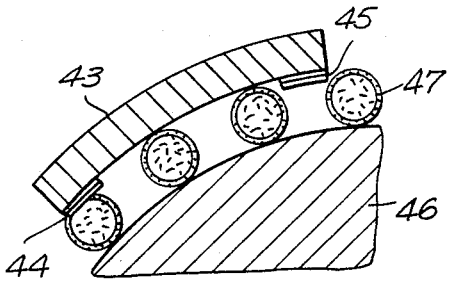
FIG. 11

FIG. 12
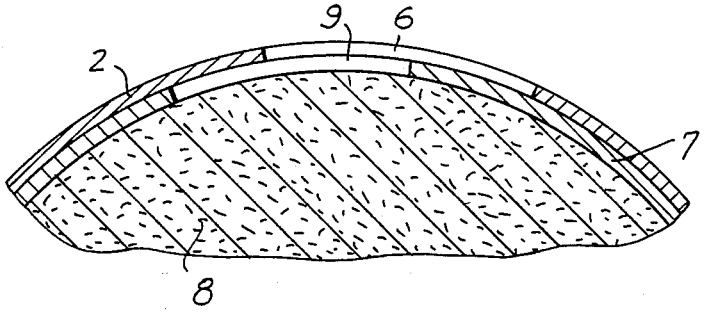
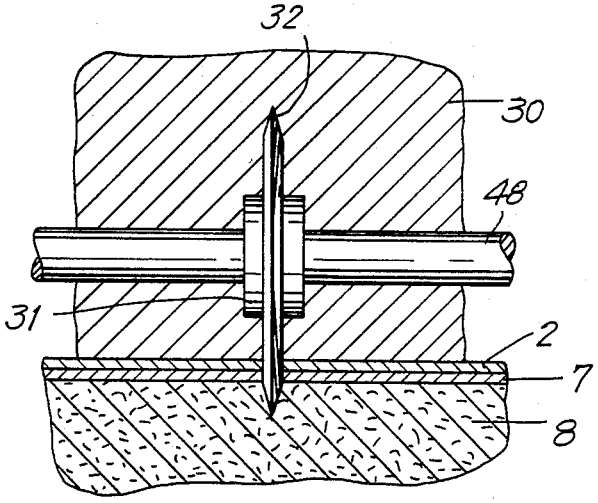
FIG. 13

FIG. 14
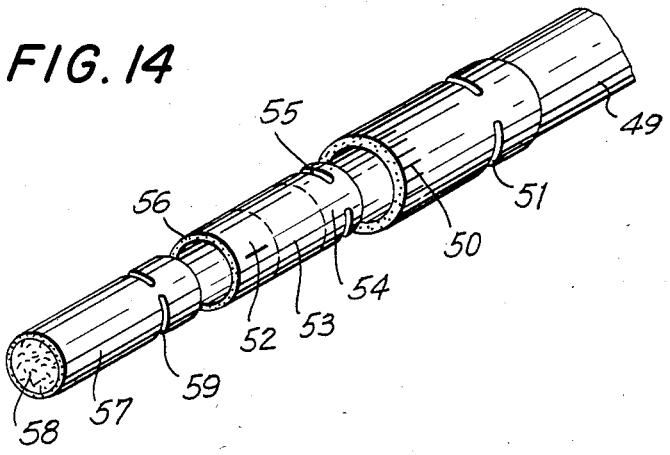
FIG. 15
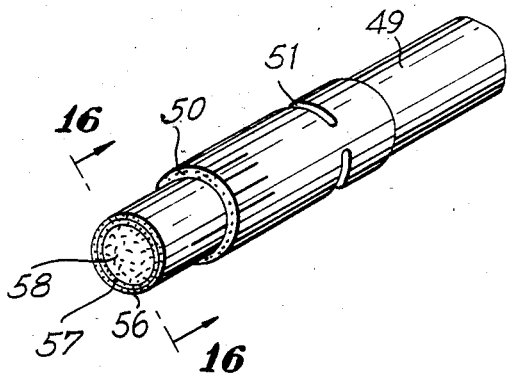
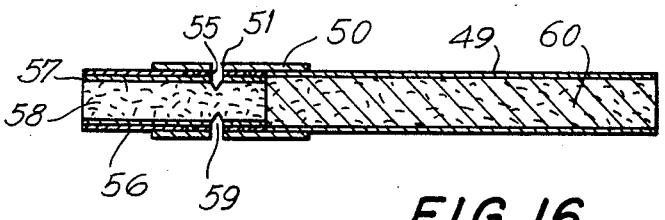
FIG. 16

FIG. 19
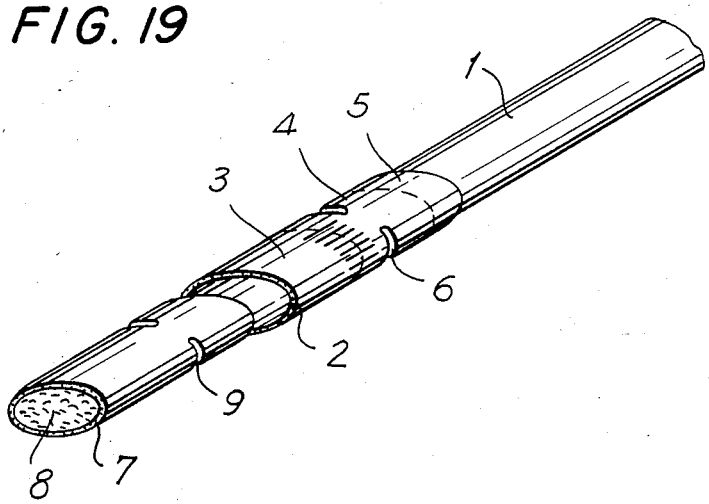
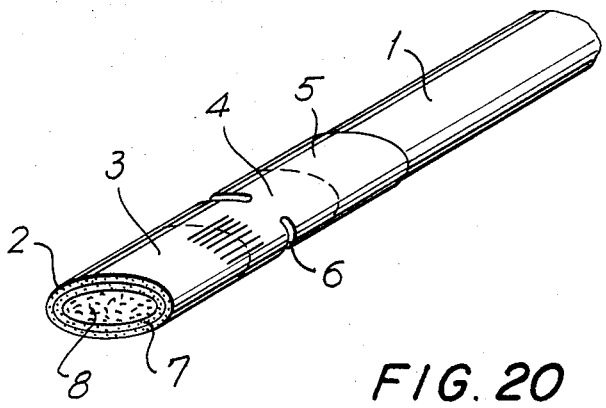
FIG. 20

CIGARETTE AND METHOD OF MAKING IT

CROSS-REFERENCE TO RELATED APPLICATION

This application is a continuation-in-part of copending U.S. patent application Ser. No. 401,380, filed July 23, 1982, now abandoned.

FIELD OF THE INVENTION

The present invention relates to cigarettes. More particularly, the present invention relates to cigarettes which are adjustable by the smoker to provide a wide range of air dilution values.

BACKGROUND OF THE INVENTION

Various mechanisms have been disclosed in heretofore issued patents which provide for adjustment of the air dilution value of a filter cigarette, but these mechanisms are not without certain disadvantages. While many complicated mechanisms have been disclosed, the simpler mechanisms generally involve making one or more openings through a substantially air-impermeable filter plug wrap and the overlying, substantially air-impermeable tipping paper and one or more corresponding openings in a sleeve which is placed over the tipping paper and which is then either rotated or moved axially to select the degree to which the two sets of openings are in registry. In another embodiment found in the art, the filter is not glued to the tipping paper and thus may be moved axially within the cylinder formed by the tipping paper. Openings are made in the filter plug wrap and corresponding openings are made in the tipping paper. The air dilution value is adjusted by axially moving the filter plug within the tipping paper to adjust the degree to which the two sets of openings are in registry.

Among the problems associated with such mechanisms are that the sleeve or filter plug may be removed from the cigarette by the smoker and not readily replaced, and that when dilution is desired, thus requiring some degree of registry between the two sets of openings, this registry may be inadvertently destroyed by a slight axial movement of the sleeve or plug. Accordingly, the dilution, once set by the smoker, is not insured of any degree of consistency. Yet another problem associated with a number of these prior devices is that they have not been readily adaptable to a high rate of production on cigarette making machinery of conventional design.

Accordingly, it is an object of the present invention to provide a cigarette which can be readily manufactured on conventional cigarette making equipment and that is adjustable to vary the ratio of air to smoke delivered to the mouth of the smoker.

SUMMARY OF THE INVENTION

A cigarette is provided which comprises a substantially cylindrical tobacco rod, that is, a charge of tobacco wrapped in cigarette paper, and an integral, axially aligned, substantially cylindrical assembly at the mouth end of the tobacco rod which preferably includes a substantially cylindrical wrapped filter plug and tipping paper, and which is provided with means to adjust the air dilution value of the cigarette. The air dilution value is the ratio of the volume of air to the volume of smoke exiting the mouth end of the filter and expressed as a percentage. The assembly has first and second ends, which are open to permit the passage of air and smoke, and at least two openings in addition to the open ends. Means are provided for rotating one opening relative to the other so that the openings are in varying degrees of registry to permit varying amounts of air to combine with the smoke, thereby varying the air dilution value of the cigarette.

In one preferred embodiment, the assembly comprises tipping paper and a substantially cylindrical, wrapped filter plug. The tipping paper and the plug wrap are substantially air impermeable. The tobacco rod and the wrapped filter plug have substantially the same cross-sectional area and shape, which may be either a circular or ovoid shape. The tipping paper is divided into three abutting bands, the first of which circumscribes a portion of one end of the filter plug and the adjoining end of the tobacco rod and is attached both to the tobacco rod and to the filter plug. The second or middle band is not attached to the plug wrap and contains a first opening. A second opening in the plug wrap is positioned beneath this second band so that the openings may, through rotation of the second band, be moved into registry. The third band is attached to the filter plug adjacent the mouth end.

In another preferred embodiment having a circular cross-section, the assembly comprises substantially air-impermeable tipping paper, an inner, contiguous, substantially air-impermeable wrapping and a substantially cylindrical filter plug wrapped in a substantially air-impermeable wrapping such as a conventional plug wrap. The inner layer is divided into three bands. The first band is located at the tobacco rod end of the filter plug, is attached to the plug wrap, and contains an opening in registry with an opening in the plug wrap. The second or middle band is not attached to the plug wrap but is attached to the tipping paper. The third band is located adjacent the mouth end of the filter plug and is attached to the plug wrap. An opening in the tipping paper is located above the first band. Since the first and third bands are attached only to the plug wrap and the middle band is attached only to the tipping paper, the filter plug may be rotated about its longitudinal axis within the cylinder formed by the tipping paper and is retained against axial movement. The openings are positioned such that rotation of the filter plug will rotate the opening in the first band into varying degrees of registry with the opening in the tipping paper. It is preferred to have the mouth end of the filter plug extend a slight distance beyond the tipping paper so that it may be readily manipulated by the smoker.

In yet another preferred embodiment, the assembly comprises at least two layers of a substantially air-impermeable wrapping, such as tipping paper, which circumscribe the tobacco rod at one end. The assembly and the tobacco rod have substantially the same cross-sectional shape, which may be either a circular or an ovoid shape. The outer wrapping is preferably tipping paper and is constructed as described in connection with the description of the outer wrapping of the first described embodiment. The innermost wrappings are either attached to or form the wrapping for the tobacco rod and have an opening positioned beneath the middle band of the outermost wrapping such that the opening therein can be rotated into varying degrees of registry with the opening through the inner wrappings. Preferably, there is a single inner wrapping which comprises the cigarette paper of the tobacco rod and the outer wrapping is tipping paper which is wrapped around the tobacco rod adjacent the mouth end.

The cigarettes of the present invention may be manufactured employing conventional equipment with only minor modifications and a method of manufacturing such cigarettes forms yet another aspect of the present invention.

BRIEF DESCRIPTION OF THE DRAWINGS

FIG. 1 is an enlarged, fragmentary, perspective view, taken from the mouth end, of the elements of a rotatable sleeve cigarette of the present invention which has a circular cross-section.

FIG. 2 is a perspective view, taken from the mouth end, of the assembled, rotatable sleeve cigarette shown in FIG. 1.

FIG. 3 is a cross-sectional view taken along the line 3—3 of FIG. 2.

FIG. 4 is a length of laser perforated tipping paper.

FIG. 5 is a view in elevation of a drag breakdown unit for use in the manufacture of cigarettes of the present invention.

FIG. 6 is an end view taken along the line 6—6 of FIG. 5.

FIG. 7 is a view in perspective of one end of the drag breakdown unit of FIG. 5.

FIG. 8 is a view in perspective of a laser system for use in making the openings in the tipping paper and inner wrappings of cigarettes of the present invention.

FIG. 9 is a partial elevational view of an apparatus for use in making perforations in the tipping paper and inner wrappings of cigarettes of the present invention.

FIG. 10 shows an alternate embodiment of the apparatus of FIG. 9 for use in making a plurality of openings in the tipping paper and inner wrappings of cigarettes of the present invention.

FIG. 11 shows yet another embodiment of the apparatus of FIG. 9 for use in making the openings in the tipping paper and inner wrappings of cigarettes of the present invention.

FIG. 12 is a cross-sectional view taken along the line 12—12 of FIG. 2 showing the relationship between the opening in the rotatable sleeve portion of the tipping paper and the opening in the plug wrap.

FIG. 13 is a cross-sectional view of the mechanical perforation apparatus of FIG. 9 taken along the line 13—13 of FIG. 9.

FIG. 14 is an enlarged, fragmentary, perspective view, taken from the mouth end, of the elements of a rotatable filter plug cigarette of the present invention.

FIG. 15 is a perspective view, taken from the mouth end, of the assembled rotatable filter plug cigarette shown in FIG. 14.

FIG. 16 is a cross-sectional view taken along the line 16—16 of FIG. 15.

FIG. 19 is an enlarged, fragmentary, perspective view, taken from the mouth end, of the elements of a rotatable sleeve cigarette of the present invention which has an ovoid cross-section.

FIG. 20 is a perspective view, taken from the mouth end, of the assembled, rotatable sleeve, oval cigarette shown in FIG. 19.

DESCRIPTION OF THE PREFERRED EMBODIMENTS

Figure 17:
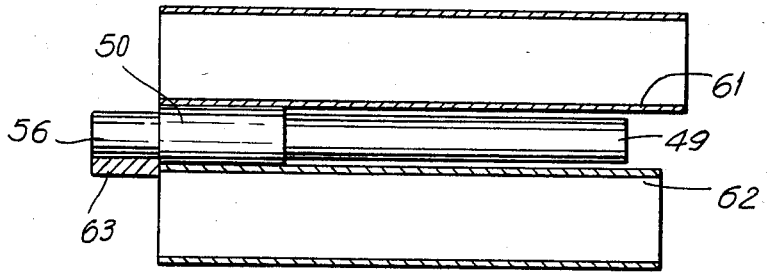
FIG. 17 is an end view of the drag breakdown unit of FIG. 5, as shown in FIG. 6, but showing a rotatable filter plug cigarette of the present invention.

The present invention will now be described with reference to the figures in which like elements are given like reference characters throughout.

One preferred embodiment of the present invention is shown in FIGS. 1, 2, and 3 and comprises a substantially cylindrical, tobacco rod 1 which is axially aligned with and joined in abutting, end-to-end relation to a conventional, substantially cylindrical filter plug 8, which may be a cellulose acetate filter or the like. The filter plug is wrapped by a substantially air-impermeable plug wrap 7 which has openings 9 therein. The tobacco rod 1 and the wrapped filter plug have substantially the same cross-sectional area and shape. The cross-sectional shape may be circular or ovoid. As shown in FIGS. 1, 2 and 3, the cigarette has a circular cross-section. The filter plug 8 is joined to the tobacco rod 1 by substantially air-impermeable tipping paper 2 which comprises a first band 5, a second band 4, and a third band 3. The second band 4 contains openings 6 which are aligned with the openings 9 in the plug wrap. Band 3 and band 5 are attached to the plug wrap and band 4 is freely rotatable about the longitudinal axis of the filter plug. As band 4 is rotated, the openings 6 are brought into varying degrees of registry with the openings 9 in the underlying plug wrap. Thus the amount of air entering the filter, where it mixes with the smoke produced by burning tobacco 10, can be selected by adjusting the degree to which the openings 6 and 9 are in registry. Band 4 is retained against axial movement by bands 3 and 5 and this, in conjunction with the frictional resistance to rotation, is such that the degree of dilution, once selected, is maintained.

Another embodiment of the rotatable sleeve cigarette is shown in FIGS. 19 and 20 and differs from the embodiment shown in FIGS. 1, 2 and 3 in having an ovoid cross-section. The cross-sectional area and shape of the tobacco rod and the wrapped filter plug are substantially the same and the tobacco rod and axially aligned, wrapped filter plug are joined to each other in abutting, end-to-end relation such that the cross-sections are in registry.

The method of the present invention is such that the cigarette may be readily produced on conventional cigarette making equipment and tipping apparatus with a minimum of modification. Forming and cutting the cigarette rod and forming and cutting the filter plug, when included, to length are done conventionally. Also, bringing the filter plug into axial alignment with the cigarette rod and the overwrapping with tipping paper are accomplished in the same manner as in conventional cigarettes.

Furthermore, additional simplicity in manufacturing is made possible in the present invention by simultaneously forming the openings in the tipping paper and inner wrappings. This is accomplished, in one manner, simply by slitting or perforating the tipping paper and underlying wrapping on each cigarette as it passes through the conventional cigarette making machinery at or near a rolling shoe station.

The rotatable sleeve embodiment may be readily manufactured. As shown in FIG. 4, a length of tipping paper is divided into bands 11, 12, and 13 by the two parallel rows of closely spaced perforations 14 and 15. These perforations may be made by any conventional means such as laser perforation, electrostatic perforation, or mechanical perforation using points or knives. It is preferred to employ a laser perforation device in order to make the perforations extremely small and minimize the possibility of even a slight axial slip in the assembled cigarette. Preferably, a laser system is employed to make about 100 perforations per inch in the paper. In practice, the tipping paper is fed through a perforating zone where it is exposed to at least a pair of laser light beams focused laterally of the width of the travelling tipping paper so as to define the desired width of the rotatable sleeve. The power settings and focusing of the laser and the rate of feed of the tipping paper are selected so as to all but part the paper along the "break away" lines 14, 15 shown in FIG. 4. The attachment which remains is selected to retain only sufficient strength to hold the bands together during assembly.

The perforated tipping paper is applied to the cigarette in a conventional cigarette making machine in which a filter is positioned between two tobacco rods, as in FIG. 8. The modification required in order to make the embodiments of the present invention using this conventional equipment is minor in that the adhesive applicator is adapted to provide a ribbon or the like of adhesive which, with reference to FIG. 8, is provided only at 3, 5, 19, and 21. This tipping paper is wrapped around the two cigarette rods and intermediate filter, then the openings are made in the tipping paper and the underlying plug wrap using conventional equipment, and then the tipping paper and filter are severed through the center of the filter along line 29 to form two filter cigarettes.

Preferably, as shown in FIG. 8, a laser perforation system is employed which uses a laser 23 to generate a laser beam that is passed through an initial focusing lens 24, then divided by beam splitter 25. One half of the beam passes through lens 27 and is focused on the tipping paper to form opening 6 while the second half of the beam is reflected by mirror 26 through lens 28 which focuses the second beam onto the tipping paper to form opening 22. The laser beam is focused to traverse the rotating cigarette and is set to remain on for a time period sufficient to make a slit of a desired length through the tipping paper and the underlying plug wrap. Slits one millimeter wide and preferred. If it is desired to establish a line of perforations instead of slits, the laser beam may be pulsed to provide a line of separate holes.

The cigarettes are then passed to a drag breakdown device, such as is shown in FIGS. 5 and 6, which employs rotating conveyor belts or rollers 16 and 17 and a skid plate 18. As shown in FIG. 6, an assembled cigarette is passed between rollers 16 and 17 and is aligned such that the middle band 4 of the tipping paper contacts a skid plate 18 which breaks the perforations in the tipping paper and frees band 4 for rotation about the longitudinal axis of the filter plug. The rates of rotation of conveyors 16 and 17 may be adjusted such that a preselected degree of rotation of band 4 occurs during breakage of the perforations and so that the cigarettes exiting the breakdown device are set at a uniform dilution value. Another view of this breakdown device is shown in FIG. 7.

The openings in the tipping paper and the underlying plug wrap may also be made by mechanical means as shown in FIGS. 9, 10, 11, and 13. As shown in FIG. 9, cigarettes 37 are passed between rotating drums 35 and 36 which feed the cigarettes beneath a fixed plate 30 and into contact with a rotating perforation device comprising rotating wheels 31 and 33, which, as shown in greater detail in FIG. 13, are rotatably mounted on shaft 48, and have pin-like projections 32 and 34 which penetrate the tipping paper and plug wrap and also penetrate a short distance within the filter. In FIG. 10, a device equivalent in function to that shown in FIG. 9, is disclosed which employs a fixed plate 38, a rotating drum 41, and sets of teeth-like projections 39 and 40 which are employed to perforate the tipping paper and plug wrap of cigarettes 42. Yet another such device is disclosed in FIG. 11 which also employs a fixed plate 43 and a rotating drum 46 and has knifelike projections 44 and 45 which make slits through the tipping paper and plug wrap of cigarettes 47. Very thin blades or finely pointed elements are used so that the vents are made to appear virtually invisible to the naked eye when observed by the smoker. One millimeter wide slits are preferred.

The dilution value of the cigarette of the present invention may be readily adjusted as shown in FIG. 12, which is a partial, cross-sectional view taken through the openings in the tipping paper and the plug wrap. Opening 6 in the tipping paper 2 may be rotated into varying degrees of registry with opening 9 in the plug wrap 7 to permit varying amounts of air to enter the filter material 8 through the two openings. Rotation of band 4 in FIG. 2 moves opening 6 relative to opening 9 thus varying the degree of registry and the amount of dilution.

Another preferred embodiment of the present invention having a circular cross-section is shown in FIGS. 14, 15, and 16 and again comprises a substantially cylindrical, tobacco rod 49 which is axially aligned with a joined in abutting, end-to-end relation to a substantially cylindrical filter plug 58, by substantially air-impermeable tipping paper 50. The filter plug 58 is wrapped with substantially air-impermeable plug wrap 57 which has openings 59 therein. The plug wrap is circumscribed by substantially air-impermeable, tipping-like paper 56 which comprises three abutting bands 52, 53, and 54. Rod-end band 54 has openings 55 therein and is attached to the plug wrap 57 such that openings 55 and 59 are fixed in registry. Central band 53 is freely rotatable about the longitudinal axis of the filter plug and mouth-end band 52 is attached to the filter plug. The twice-wrapped filter plug 58 is then joined to the tobacco rod 49 by tipping paper 50 having openings 51 therein. Band 53 is attached to the inner surface of tipping paper 50. The filter plug extends beyond the tipping paper 50 to provide a stub which may be manipulated by the smoker. Since band 53 is attached to the inner surface of the tipping paper and since bands 52 and 54 are attached to the plug wrap, the filter plug is freely rotatable within the cylinder formed by the tipping paper and yet is retained against axial movement. This retention against axial movement, in conjunction with the frictional resistance to rotation, is such that the degree of dilution, once selected, is maintained. Openings 51 are positioned such that as the filter plug 58 is rotated, openings 55 are brought into varying degrees of registry with openings 51. The intermediate layer 56 is preferably the same paper as tipping paper 50 in order to present a uniform appearance to the smoker. If desired, paper 56 may be eliminated and the plug wrap 57 may comprise three abutting bands corresponding to 52, 53, and 54 in FIG. 14.

The cigarettes of this rotatable plug embodiment are manufactured substantially as set forth above in connection with the rotatable sleeve embodiment. When an intermediate tipping paper layer is employed, it is perforated, preferably using a laser system as set forth above, and is then attached to the plug wrap, preferably with glue. Conventional equipment is again employed and modified such that the glue applicator will apply glue only to the plug wrap side of bands 52 and 54. The glue applicator is also modified so that the glue is applied to the plug side of tipping paper 50 only on those portions which will contact the tobacco rod 49 and the sleeve 53. Otherwise, the manufacture of this embodiment is substantially the same as for the rotatable sleeve embodiment.

It is preferred to make the openings through the outer tipping paper, the inner tipping paper or other such intermediate wrapping, and the plug wrap at the same time using the laser perforation system as shown in FIG. 8, although one of the mechanical systems shown in FIGS. 9, 10 and 11 may be employed. The assembled cigarettes are then passed through a drag breakdown device as described with reference to FIGS. 5, 6, and 7, but the alignment of the cigarettes within the device is altered as shown in FIG. 17 such that the protruding end of the filter plug contacts the drag plate thereby breaking the perforations in the inner layer of tipping paper; thus permitting the filter plug to freely rotate within the outer cylinder of tipping paper while being axially retained therein.

Figure 18:
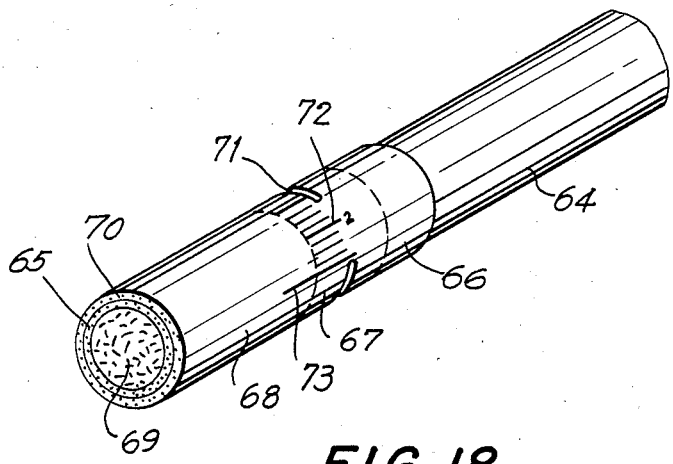
FIG. 18 is a perspective view, taken from the mouth end, of an assembled, unfiltered, rotatable sleeve cigarette of the present invention which has a circular cross-section and which has indicia printed on the tipping paper.

Yet another preferred embodiment of the present invention is shown in FIG. 18 and comprises a substantially cylindrical tobacco rod 64 which is a column of tobacco 69 circumscribed by a substantially air-impermeable wrapping 65, preferably cigarette paper, which is, in turn, circumscribed adjacent the mouth end by an outer, cylindrical layer 70 of substantially air-impermeable tipping paper extending from the mouth end to a point between the mouth end and the middle of the tobacco rod. This embodiment may have either a circular or ovoid cross-sectional shape. The tobacco rod 64 is open at both the coal end and the mouth end to permit the passage of air and smoke. The outermost layer 70 comprises three bands, 66, 67 and 68 which are formed and positioned as described with reference to FIGS. 1, 2 and 3. There is an opening through the inner layer 65, and an opening 71 in band 67 positioned so that it can be rotated into varying degrees of registry with the opening in the inner layer by rotating band 67. This embodiment may be made according to the method described for making the embodiment shown in FIGS. 1, 2 and 3, omitting the step of inserting a double length filter plug between the two tobacco rods.

A means for permitting the smoker to select the specific smoke to air dilution ratio desired may be provided through indicia (72 and 73 in FIG. 18, for example) which may be printed on the tipping paper during the passage of the cigarette through the tipping apparatus. Such indicia are made readily visible and are designed to show the degree of registry of the openings.

It will be understood that the particular embodiments described above are only illustrative of the principles of the present invention, and that various modifications can be made by those skilled in the art without departing from the scope and spirit of the present invention. For example, the embodiment shown in FIGS. 1, 2 and 3 could be modified by omitting the filter plug thus resulting in an integral mouthpiece; the embodiment shown in FIGS. 14, 15 and 16 could be constructed with the first and third bands glued or otherwise fixed to the tipping paper and the second band attached or fixed to the plug wrap; and, in the embodiment shown in FIG. 18, the opening in the inner wrap could be made in the second band instead of or as well as in the first with corresponding openings being made in the outer layer of tipping paper.

We claim:

1. A filter cigarette, comprising:

a substantially cylindrical tobacco rod;

a substantially cylindrical, wrapped filter plug, wherein the filter plug has first and second ends open to permit the passage of air and smoke, the wrapping has a first opening therein, the tobacco rod and the filter plug are axially aligned in abutting, end-to-end relationship;

tipping paper wherein the tipping paper has a second opening therein and circumscribes and joins the tobacco rod to the filter plug;

at least one of said wrapping and said tipping paper being substantially air-impermeable;

means for rotating one opening relative to the other so that the first and second openings are in varying degrees of registry to admit varying amounts of air to the filter plug, thereby diluting the smoke; and means for retaining the tipping paper against axial movement relative to the filter plug.

2. The filter cigarette of claim 1 wherein said wrapping and said tipping paper are substantially air-impermeable.

3. The filter cigarette of claim 1 wherein said wrapping is air-permeable and said tipping paper is substantially air-impermeable.

4. The filter cigarette of claim 1 wherein said wrapping is substantially air-impermeable and said tipping paper is air-permeable.

5. A filter cigarette, comprising a substantially cylindrical tobacco rod, a substantially cylindrical, wrapped filter plug, and tipping paper, wherein the tobacco rod and the wrapped filter plug have substantially the same cross-sectional area and shape, the filter plug has a rod end and a mouth end open to permit the passage of air and smoke, the wrapping has a first opening therein, the tobacco rod and the filter plug are axially aligned in abutting end-to-end relationship and circumscribed and joined by the tipping paper, the tipping paper comprises, in sequence, first, second, and third abutting bands, the first band overlaps and is fixed to the tobacco rod and the filter plug, the second band is rotatable about the longitudinal axis of the filter plug and has a second opening therein positioned so that the second opening is rotatable into registry with the first opening, and the third band is fixed to the filter plug at the mouth end of the filter plug, thereby retaining the second band against axial movement, at least one of said wrapping and said tipping paper being substantially air-impermeable.

6. The filter cigarette of claim 5 wherein the tobacco rod and the wrapped filter plug have a circular cross-section.

7. The filter cigarette of claim 5 wherein the tobacco rod and the wrapped filter plug have an ovoid cross-section and the cross-sections are in registry.

8. The filter cigarette of claim 5 wherein the first band is glued to the tobacco rod and the filter plug, and the third band is glued to the filter plug adjacent the mouth end of the filter plug.

9. The filter cigarette of claim 5 including a plurality of first openings in the wrapping and a plurality of second openings in the second band positioned such that the second openings are rotatable into registry with the first openings in a one-to-one correspondence.

10. The filter cigarette of claim 5 wherein said wrapping and said tipping paper are substantially air-impermeable.

11. The filter cigarette of claim 5 wherein said wrapping is air-permeable and said tipping paper is substantially air-impermeable.

12. The filter cigarette of claim 5 wherein said wrapping is substantially air-impermeable and said tipping paper is air-permeable.

13. A filter cigarette, comprising a substantially cylindrical tobacco rod, a substantially cylindrical, wrapped filter plug, an intermediate wrapping, and tipping paper, wherein the filter plug has a rod end and a mouth end open to permit the passage of air and smoke, the wrapping of said filter plug underlies said intermediate wrapping and has a first opening therein, the intermediate wrapping comprises, in sequence, first, second, and third abutting bands, the first band has a second opening therein in registry with the first opening and is fixed to the underlying wrapping adjacent the rod end of the filter plug for rotation therewith, the second band is fixed to the tipping paper whereby the filter plug is rotatable about the longitudinal axis of the filter plug within the second band and is fixed against axial movement, the third band is fixed to the underlying wrapping adjacent the mouth end of the filter plug for rotation therewith, the tobacco rod and the filter plug are axially aligned in abutting, end-to-end relation and are circumscribed and joined by the tipping paper, the tipping paper extends from a position on the tobacco rod adjacent the mouth end of the tobacco rod substantially to the mouth end of the filter plug and has a third opening therein positioned so that the second opening is rotatable into registry with the third opening, at least one of said underlying wrapping, said intermediate wrapping, and said tipping paper being substantially air-impermeable.

14. The filter cigarette of claim 13 including a plurality of first openings in the underlying wrapping, a plurality of second openings in the first band in registry with the first openings and a plurality of third openings in the tipping paper positioned such that the third openings are rotatable into registry with the second openings in a one-to-one correspondence.

15. The filter cigarette of claim 13 wherein the first band is glued to the filter plug adjacent the rod end of the filter plug, the second band is glued to the tipping paper, and the third band is glued to the filter plug adjacent the mount end of the filter plug.

16. The filter cigarette of claim 13 wherein said underlying wrapping, said intermediate wrapping, and said tipping paper are substantially air-impermeable.

17. The filter cigarette of claim 13 wherein said underlying wrapping is substantially air-impermeable and said intermediate wrapping and said tipping paper are air-permeable.

18. The filter cigarette of claim 13 wherein said intermediate wrapping is substantially air-impermeable and said underlying wrapping and said tipping paper are air-permeable.

19. The filter cigarette of claim 13 wherein said underlying wrapping and said intermediate wrapping are substantially air-impermeable and said tipping paper is air-permeable.

20. The filter cigarette of claim 13 wherein said underlying wrapping and said intermediate wrapping are air-permeable and said tipping paper is substantially air-impermeable.

21. The filter cigarette of claim 13 wherein said underlying wrapping is air-permeable and said intermediate wrapping and said tipping paper are substantially air-impermeable.

22. The filter cigarette of claim 13 wherein said intermediate wrapping is air-permeable and said underlying wrapping and said tipping paper are substantially air-impermeable.

23. A cigarette, comprising a substantially cylindrical tobacco rod having a coal end and a mouth end open to permit the passage of air and smoke, the tobacco rod comprising a column of tobacco circumscribed by a wrapping having a first opening therein, and an outer, cylindrical layer of tipping paper extending from the mouth end to a point between the mouth end and the middle of the tobacco column, the tipping paper comprising, in sequence, first, second, and third abutting bands, wherein the first band is fixed to the wrapping, the second band is rotatable about the longitudinal axis of the tobacco column and has a second opening therein positioned so that the second opening is rotatable into registry with the first opening, and the third band is fixed to the wrapping adjacent the mouth end, thereby retaining the second band against axial movement, at least one of said wrapping and said tipping paper being substantially air-impermeable.

24. The cigarette of claim 23 wherein the tobacco rod has a circular cross-section.

25. The cigarette of claim 23 wherein the tobacco rod has an ovoid cross-section.

26. The cigarette of claim 23 wherein said wrapping and said tipping paper are substantially air-impermeable.

27. The cigarette of claim 23 wherein said wrapping is air-permeable and said tipping paper is substantially air-impermeable.

28. The filter cigarette of claim 23 wherein said wrapping is substantially air-impermeable and said tipping paper is air-permeable.

29. A filter cigarette, comprising a substantially cylindrical tobacco rod, a substantially cylindrical, wrapped filter plug, and tipping paper, wherein the tobacco rod and the wrapped filter plug have substantially the same cross-sectional area and have ovoid cross sections in registry, the filter plug has a rod end and a mouth end open to permit the passage of air and smoke, the wrapping has a first opening therein, the tobacco rod and the filter plug are axially aligned in abutting end-to-end relationship and circumscribed and joined by the tipping paper, the tipping paper comprises, in sequence, first, second, and third abutting bands, the first band overlaps and is fixed to the tobacco rod and the filter plug, the second band is rotatable about the longitudinal axis of the filter plug and has a second opening therein positioned so that the second opening is rotatable into registry with the first opening, and the third band is fixed to the filter plug at the mouth end of the filter plug, thereby retaining the second band against axial movement, at least one of said wrapping and said tipping paper being substantially air-impermeable.

30. The filter cigarette of claim 29 wherein the first band is glued to the tobacco rod and the filter plug, and the third band is glued to the filter plug adjacent the mouth end of the filter plug.

31. The filter cigarette of claim 29 including a plurality of first openings in the wrapping and a plurality of second openings in the second band positioned such that the second openings are rotatable into registry with the first openings in a one-to-one correspondence.

32. The cigarette of claim 29 wherein said wrapping and said tipping paper are substantially air-impermeable.

33. The cigarette of claim 29 wherein said wrapping is air-permeable and said tipping paper is substantially air-impermeable.

34. The filter cigarette of claim 29 wherein said wrapping is substantially air-impermeable and said tipping paper is air-permeable.

35. A cigarette, comprising a substantially cylindrical tobacco rod having an ovoid cross section and having a coal end and a mouth end open to permit the passage of air and smoke, the tobacco rod comprising a column of tobacco circumscribed by a wrapping having a first opening therein, and an outer, cylindrical layer of tipping paper extending from the mouth end to a point between the mouth end and the middle of the tobacco column, the tipping paper comprising, in sequence, first, second, and third abutting bands, wherein the first band is fixed to the wrapping, the second band is rotatable about the longitudinal axis of the tobacco column and has a second opening therein positioned so that the second opening is rotatable into registry with the first opening, and the third band is fixed to the wrapping adjacent the mouth end, thereby retaining the second band against axial movement, at least one of said wrapping and said tipping paper being substantially air-impermeable.

36. The cigarette of claim 35 wherein said wrapping and said tipping paper are substantially air-impermeable.

37. The cigarette of claim 35 wherein said wrapping is air-permeable and said tipping paper is substantially air-impermeable.

38. The filter cigarette of claim 35 wherein said wrapping is substantially air-impermeable and said tipping paper is air-permeable.

* * * * *